US007693467B2

(12) United States Patent
Kadowaki

(10) Patent No.: US 7,693,467 B2
(45) Date of Patent: Apr. 6, 2010

(54) IMAGE FORMING APPARATUS

(75) Inventor: Seijiro Kadowaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 472 days.

(21) Appl. No.: 11/690,387

(22) Filed: Mar. 23, 2007

(65) Prior Publication Data

US 2007/0231020 A1 Oct. 4, 2007

(30) Foreign Application Priority Data

Mar. 28, 2006 (JP) ..... 2006-088261

(51) Int. Cl.
*G06G 15/01* (2006.01)

(52) U.S. Cl. ..... 399/301; 399/49; 347/116

(58) Field of Classification Search ..... 399/49, 399/72, 165, 301; 347/116
See application file for complete search history.

(56) References Cited

U.S. PATENT DOCUMENTS

| | | | | |
|---|---|---|---|---|
| 4,903,067 | A | 2/1990 | Murayama et al. | |
| 5,287,162 | A | 2/1994 | de Jong et al. | |
| 5,946,537 | A * | 8/1999 | Nakayasu et al. | 399/301 |
| 6,198,896 | B1 * | 3/2001 | Nakayasu et al. | 399/301 |
| 2005/0058470 | A1 * | 3/2005 | Funamoto et al. | 399/167 |
| 2005/0212887 | A1 * | 9/2005 | Tanaka et al. | 347/116 |
| 2005/0275707 | A1 | 12/2005 | Oku | |

FOREIGN PATENT DOCUMENTS

| | | |
|---|---|---|
| JP | 63271275 | 11/1988 |
| JP | 6118735 | 4/1994 |
| JP | 2001-034026 | 2/2001 |
| JP | 2001-134036 | 5/2001 |
| JP | 2005-091537 | 4/2005 |
| JP | 2005-352082 | 12/2005 |

* cited by examiner

*Primary Examiner*—David P Porta
*Assistant Examiner*—Benjamin Schmitt
(74) *Attorney, Agent, or Firm*—Banner & Witcoff, Ltd

(57) ABSTRACT

A feeding unit that feeds a medium, a plurality of image carriers arranged in parallel along a moving direction of the medium, a developer image forming unit that forms a developer image on the plurality of image carriers, and a transfer unit that transfers the developer image formed on the plurality of image carriers onto the medium is described. The developer image forming unit forms a first developer image on a first image carrier of the plurality of image carriers, the first developer image being used for transferring a first pattern at a first interval on the medium along the feeding direction. Also, the developer image forming unit forms a second developer image on a second image carrier of the plurality of image carriers, the second developer image at the first interval and a second interval alternately on the medium along the feeding direction.

20 Claims, 10 Drawing Sheets

$$d = \frac{x2\text{-}x1}{\tan\theta}$$

IMAGE FORMING APPARATUS

CROSS REFERENCE TO RELATED APPLICATION

This application claims priority from Japanese Patent Application No. 2006-088261 filed Mar. 28, 2006. The entire content of this priority application is incorporated herein by reference.

FIELD

The disclosure relates to a so called tandem type image forming apparatus, and more specifically, to a technique for detecting deviation amounts of the respective color images.

BACKGROUND

Generally, an image forming apparatus of a so-called tandem type has been known. This type of image forming apparatus has a structure in which multiple pairs of photo conductor and transfer unit corresponding to such colors as yellow, magenta, cyan and black are aligned adjacent to an intermediate transfer belt along its moving direction. The developer images of those colors carried on the respective photo conductors are sequentially transferred to the predetermined positions on the intermediate transfer belt such that the color developer image formed on the intermediate transfer belt is transferred onto the sheet.

In the aforementioned tandem type image forming apparatus, the deviation of the transfer position of the developer images corresponding to the respective colors to be transferred to the intermediate transfer belt by the photo conductors causes the color shift in the resultant color developer image. It is, therefore important to perform transfer registration with respect to the developer images of the respective colors. For example, some systems include a technique for sequentially transferring the registration patterns (for alignment) formed of a plurality of marks at intervals onto the intermediate transfer belt by the photo conductor of each color along the moving direction of the intermediate transfer belt. In the aforementioned technique, the deviation of the transfer onto the intermediate transfer belt by the photo conductors of the respective colors, that is, the positional deviation of the respective color images will come out as the deviation between the registration patterns corresponding to the respective colors transferred onto the intermediate transfer belt. Each edge of the registration patterns of the respective colors is detected by an optical sensor disposed adjacent to the intermediate transfer belt to obtain the amount of the deviation of the color images, based on which the timing for transferring by the photo conductors of the respective colors is corrected.

In the technique as described above, the actual deviation amount of the color images is directly reflected as being dimensionally the same as the deviation of the edge of the registration patterns corresponding to the respective colors. In other words, the detection accuracy with respect to the deviation of the edge directly influences the detection accuracy of the deviation amount of the respective color images. In a structure in which the optical sensor detects the deviation amounts of the color images as described above, for example, when the optical sensor is configured to detect the deviation to a maximum level of A mm, the detection with accuracy higher than the level of A mm cannot be realized.

SUMMARY

According to one aspect of the present invention, an image forming apparatus can include a plurality of photo conductors arranged in parallel along a moving direction of the medium, a developer image forming unit that forms a developer image on the plurality of photo conductors, and a transfer unit that transfers the developer image formed on the plurality of photo conductors onto the medium. The developer image forming unit forms a first developer image on a first photo conductor of the plurality of photo conductors, the first developer image being used for transferring a first pattern at a first interval on the medium along the feeding direction. Also, the developer image forming unit forms a second developer image on a second photo conductor of the plurality of photo conductors, the second developer image at the first interval and a second interval alternately on the medium along the feeding direction.

The term "medium" represents a sheet material such as a sheet of paper and an OHP sheet, or a carrier belt that conveys the sheet material in the case where the image forming apparatus is of direct transfer tandem type. Meanwhile, in the case where the image forming apparatus is of intermediate transfer tandem type, the "medium" represents an intermediate medium (intermediate transfer belt). The tandem type may be formed either as a vertical type or a horizontal type.

The term "image forming apparatus" may be not only a single printer but also a complex machine serving as both the printer and the scanner. Also it may be formed as a facsimile machine.

Referring to FIG. 1 ($\alpha$=2p, for example. "$\alpha$" may be either a positive or a negative value.), a first pattern formed of a plurality of first marks M (black mark) arranged at first intervals (X) is transferred onto the medium by a first photo conductor. Likewise a second pattern formed of a plurality of second marks N (shaded marks) arranged at the first intervals (X) and second intervals (X+$\alpha$) alternately are transferred onto the medium by a second photo conductor. The pattern at the center in the left-to-right direction of the drawing shows the transfer result with no deviation of the transfer position between the first pattern transferred by the first photo conductor and the second pattern transferred by the second photo conductor (no deviation in the respective images). This state will be referred to as a "normal transfer result" hereinafter. The patterns at the right side show the transfer results where the deviation of the transfer position becomes p, 2p and 3p, respectively. The patterns at the left side show the transfer results where the deviation of the transfer position becomes −p, −2p, and −3p, respectively. The positive and the negative signs represent the forward and reverse directions with respect to the moving direction of the medium. Referring to the drawing, both the first and the second patterns are transferred in alignment along the moving direction. However, those patterns may be transferred to be shifted with each other in the direction orthogonal to the moving direction.

The following findings (1) and (2) may derived from the aforementioned patterns shown in FIG. 1.

(1) Each difference of the distance between the first mark M and the two second marks N adjacent to the front and to the rear thereof changes by $\alpha$ (=2p) along the moving direction; and (2) In the case where the difference between the distance from the first mark M to the second mark N adjacent to the front thereof and the distance from the first mark M to the second mark N adjacent to the rear thereof or the ratio of the aforementioned distances is set to a predetermined value (including zero), the first mark M (hereinafter referred to as a "specific mark") moves to the previous mark M or the subsequent mark M as the transfer position deviates by the distance p. Specifically, referring to the normal transfer result at the center of FIG. 1, assuming that the transfer position of the first mark M5 between the two adjacent second marks N deviates by the value p, it is shifted to the first mark M4 as shown in FIG. 1. Meanwhile, when the transfer position deviates by the value 2p, the first mark M5 is shifted to the first mark M3.

In view of the aforementioned findings (1) and (2), at least the following method of detecting the transfer position may be obtained.

The first mark as the specific mark is identified from those marks of the first pattern of the actual transfer result. Based on the information with respect to the order number of the first mark identified as the specific mark shifted from the specific mark identified in the normal transfer result (the difference in the order of the first mark as the specific mark from the normal transfer result to the actual transfer result), and the value p ($=\alpha/2$), the deviation amount of the transfer position is detected.

The difference of the distance between the first mark M and the second mark N adjacent to the front thereof, and the first mark M and the second mark N adjacent to the rear thereof changes by $\alpha$ ($=2p$) in the moving direction. In this case, the specific mark may be identified so long as the minimum detectable unit (with respect to the amount of change) in the aforementioned distance difference is about 2p ($=\alpha$). Accordingly, the change in the deviation amount of the transfer position may be detected with an accuracy half the minimum unit, that is, the value p.

According to one or more aspects of the invention, the deviation amount of the transfer position may be detected with higher accuracy than the one required for detecting the transfer result including the first and the second patterns.

BRIEF DESCRIPTION OF THE DRAWINGS

Illustrative aspects in accordance with the invention will be described in detail with reference to the following figures wherein.

DETAILED DESCRIPTION

Various aspects of the invention will be described referring to FIGS. 1 to 6.

It is noted that various connections are set forth between elements in the following description. It is noted that these connections in general and, unless specified otherwise, may be direct or indirect and that this specification is not intended to be limiting in this respect.

For purposes herein, aspects of the invention are shown in relation to an image carrier and developer carrier. In various aspects, the image carrier may include a photosensitive drum, photosensitive belt, or the combination of one of a photosensitive drum or belt and an intermediate transfer drum or belt. Further, the developer carrier may include a developer roller or other systems for conveying developer to the image carrier.

General Structure of Printer

Figure 2:
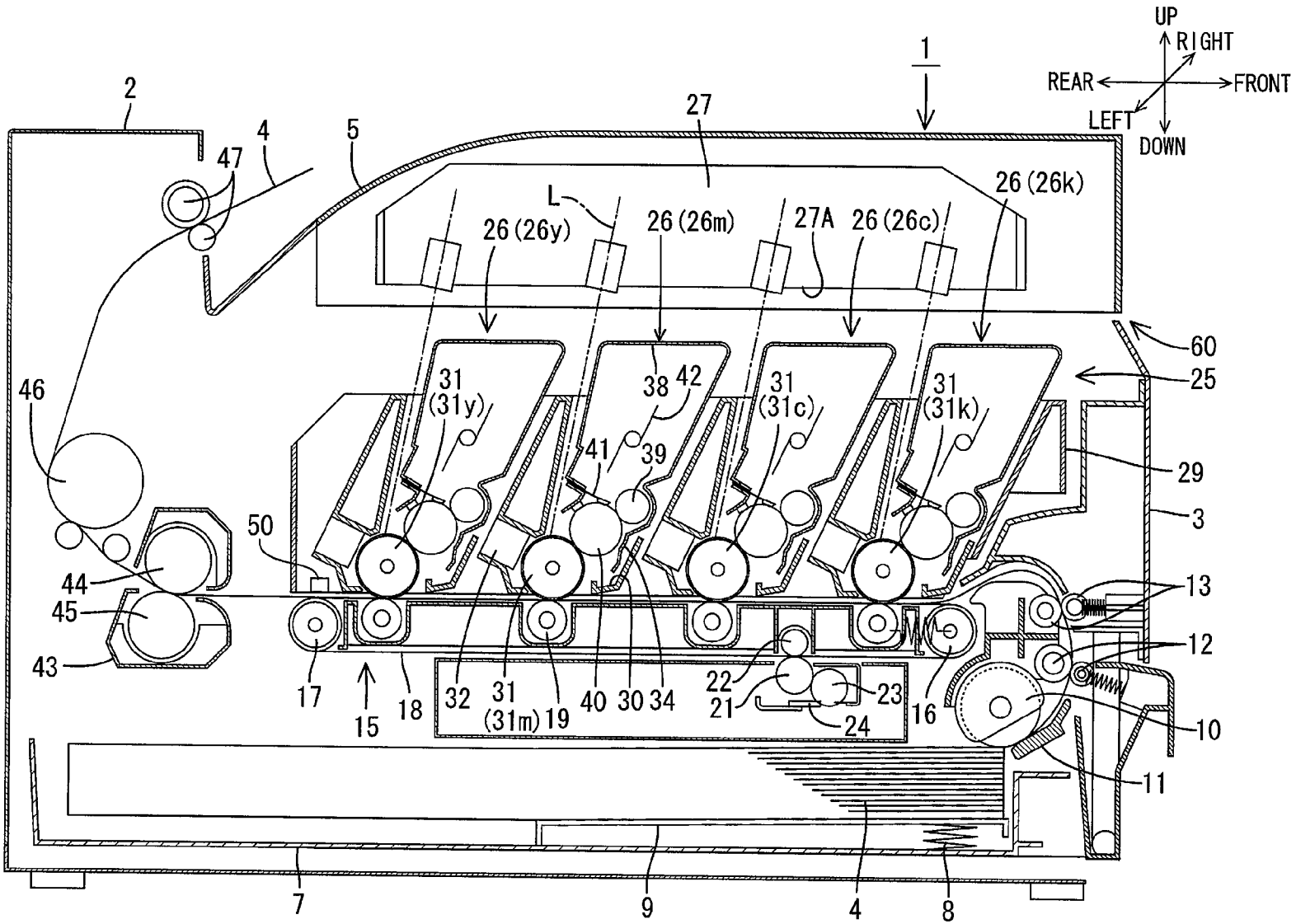
FIG. 2 is a schematic sectional side elevation of the center of a printer according to a aspect of the invention.

FIG. 2 is a sectional side elevation schematically showing a structure of a printer 1 (an example of "image forming apparatus"). In the explanation, the right side of FIG. 2 is defined as the front side of the printer 1.

The printer 1 is a color printer of direct transfer tandem type and includes a box-like casing 2 as shown in FIG. 2. A front cover 3 that can be opened and closed is attached to the front surface of the casing 2. A process unit 25 within the casing 2 may be pulled forward by opening the front cover 3. A catch tray 5 is formed on the upper surface of the casing 2, on which a sheet of paper 4 as the sheet material which has been subjected to the image forming process is stacked.

A feeder tray 7 that contains stack of the sheets of paper 4 to be subjected to the image forming process is installed at the lower portion of the casing 2 so as to be configured to being pulled forward. The feeder tray 7 includes a platen 9 diagonally movable to lift up the front edge of the sheet 4 under the urging force of a spring 8. A pickup roller 10 and a separation pad 11 in press contact with the pickup roller 10 under the urging force of a spring (not shown) are disposed above the front end portion of the feeder tray 7. A pair of feeder rollers 12 and 12 is provided diagonally above the pickup roller 10. A pair of registration rollers 13 and 13 is provided above the feeder rollers.

The top sheet 4 of those stacked on the feeder tray 7 is kept pressed by the platen 9 against the pickup roller 10. As the pickup roller 10 rotates, the sheet 4 is gripped between the pickup roller 10 and the separation pad 11 so as to be separated one by one. The sheet 4 gripped between the pickup roller 10 and the separation pad 11 is fed to the registration rollers 13 through the feeder rollers 12. The registration rollers 13 feed the sheet 4 to a belt unit 15 rearward at a predetermined timing.

The belt unit 15 is detachably installed in the casing 2, and equipped with a pair of support rollers 16, 17 apart from each other in the front-to-rear direction, and a sheet conveying belt 18 wound around the support rollers 16, 17 to horizontally extend therebetween. The belt 18 is an endless belt formed of a resin material. As the rear support roller 17 is driven to rotate by a motor (not shown), it circularly moves counterclockwise in FIG. 2 to convey the sheet 4 on the upper surface of the belt 18 rearward. Inside the belt unit 18, four transfer rollers 19 (an example of "transfer unit"), for example, are arranged in the front-to-rear direction at uniform intervals. The transfer rollers 19 are disposed opposite the corresponding photo conductor drums 31 (an example of "photo conductor") provided in the respective image forming units 26 (described later) such that the belt 18 is gripped between the photo conductor drums 31 and the corresponding transfer rollers 19. During the transfer process, the transfer bias is applied between the transfer roller 19 and the photo conductor drum 31. In this aspect, a registration pattern is transferred onto the belt 18 as described below. The belt 18, thus, is an example of the "medium". The moving direction of the upper portion of the belt 18 (in the direction from the right to the left in FIG. 2), that is, the conveying direction of the sheet 4 is an example of the "moving direction of the medium".

A cleaning roller 21 for removing the toner or paper dust adhered onto the belt 18 is disposed below the belt unit 15. The cleaning roller 21 is formed by coating a foam material formed of silicone rubber around a metal shaft member, and is disposed opposite a metal backup roller 22 attached to the belt unit 15 such that the belt 18 is held therebetween. A predetermined bias is applied between the cleaning roller 21 and backup roller 22, whereby the toner on the belt 18 is electrically transferred toward the cleaning roller 21. The cleaning roller 21 also abuts against a metal collection roller 23 to remove the toner and the like adhered to the surface of the cleaning roller 21. The collection roller 23 further abuts against a blade 24 for scratching off the toner and the like adhered to the surface of the collection roller 23.

A scanner unit 27 serving as a laser scanner is disposed within the casing 2 at the upper portion. The process unit 25 is disposed below the scanner unit 27, and the belt unit 15 is disposed below the process unit 25.

The scanner unit 27 emits the laser beam L based on the respective color image data to the surfaces of the photo conductor drums 31 through high-speed scanning.

The process unit 25 includes four image forming units 26 corresponding to four colors of black (BK), cyan (C), magenta (M) and yellow (Y) which are aligned in the front-to-rear direction. Note that, in this aspect, the image forming units 26 corresponding to black, cyan, magenta and yellow are arranged in the order from the front side of the printer 1. Each of the image forming units 26 includes the photo conductor drum 31, a scorotron type charger 32, a developer cartridge 34 and the like. The process unit 25 is provided with a frame 29 which includes four attachments 30 aligned in the front-to-rear direction. Each of the attachments 30 is open at its upper and lower portions, which allows the corresponding developer cartridge 34 to be detachably set inside. The frame 29 holds the photo conductor drums 31 of the respective image forming units 26 at the lower end of the respective attachments 30, and further holds the chargers 32 adjacent to the respective photo conductor drums 31.

The photo conductor drum 31 is formed by coating a grounded metal drum body with a positively charged photo conductive layer formed of the polycarbonate and other materials.

The charger 32 is disposed diagonally above the rear of the photo conductor drum 31 at a predetermined interval so as not to be in contact therewith. The charger 32 allows the charger wire (not shown) formed of tungsten and the like to generate corona discharge such that the entire surface of the photo conductor drum 31 is positively charged.

The developer cartridge 34 has a substantially box-like shape, and is provided inside thereof with a toner storage chamber 38 at the upper portion, and a feed roller 39, a developer roller 40 and a layer thickness regulation blade 41 at the lower portion. The respective storage chambers 38 contain positively charged toner as the developer having a nonmagnetic single content corresponding to black, cyan, magenta and yellow, respectively. Each of the storage chambers 38 includes an agitator 42 that agitates the toner.

The feed roller 39 is formed by coating the metal roller shaft with the conductive foaming material, and the developer roller 40 is formed by coating the metal roller shaft with the conductive rubber material. The toner discharged from the storage chamber 38 is fed to the developer roller 40 through the rotation of the feed roller 39, and is positively friction charged between the feed roller 39 and the developer roller 40. The toner supplied onto the developer roller 40 is further fed between the layer thickness regulation blade 41 and the developer roller 40 accompanied with the rotation of the developer roller 40 so as to be sufficiently friction charged. The resultant thin layered toner with uniform thickness is carried on the developer roller 40.

The surface of the photo conductor drum 31 is entirely charged by the charger 32. Thereafter, the surface of the photo conductor drum 31 is exposed to the high speed scanning of the laser beam emitted from the scanner unit 27 to form the electrostatic latent image corresponding to the image formed on the sheet 4.

When the positively charged toner carried on the developer roller 40 is brought into contact with the opposite photo conductor drum 31 through the rotation of the developer roller 40, it is supplied to the electrostatic latent image formed on the surface of the photo conductor drum 31. The electrostatic latent image on the photo conductor drum 31 is then visualized, and a toner image (developer image) formed by the toner adhering only to the exposed portion is carried on the surface of the photo conductor drum 31.

The toner images carried on the surface of the photo conductor drums 31 will be sequentially transferred to the sheet 4 under the negatively charged transfer bias applied to the transfer rollers 19 while the sheet 4 is conveyed on the belt 18 through the respective transfer positions between the photo conductor drums 31 and the transfer rollers 19, respectively. The sheet 4 having the toner image transferred is conveyed to a fixation unit 43.

The fixation unit 43 heats the sheet 4 that carries the toner images of four colors while being gripped and conveyed between the heat roller 44 and the pressure roller 45 so as to fix the toner image on the sheet 4. The heat fixed sheet 4 is conveyed to discharge rollers 47 at the upper portion of the casing 2 by the carrier roller 46 diagonally above the rear of the fixation unit 43. The sheet 4 is then discharged to the aforementioned catch tray 5 by the discharge rollers 47.

Referring to FIG. 2, a sensor 50 is disposed to the rear of the image forming unit 26Y of yellow. The sensor 50 is a reflective type optical sensor equipped with a light emitting element that emits light onto the belt 18 and a light receiving element that receives the light reflecting from the belt 18. The level of the light quantity received by the light receiving element varies depending on whether or not the respective marks of the registration pattern to be described later enter into the irradiation spot of the sensor 50 on the belt 18. A detection signal S in accordance with the level of the received light quantity is output from the sensor 50. In this aspect, the irradiation spot of the sensor 50 is set to one end side either left or right of the belt 18.

Structure for Controlling the Scanner Unit

Figure 3:
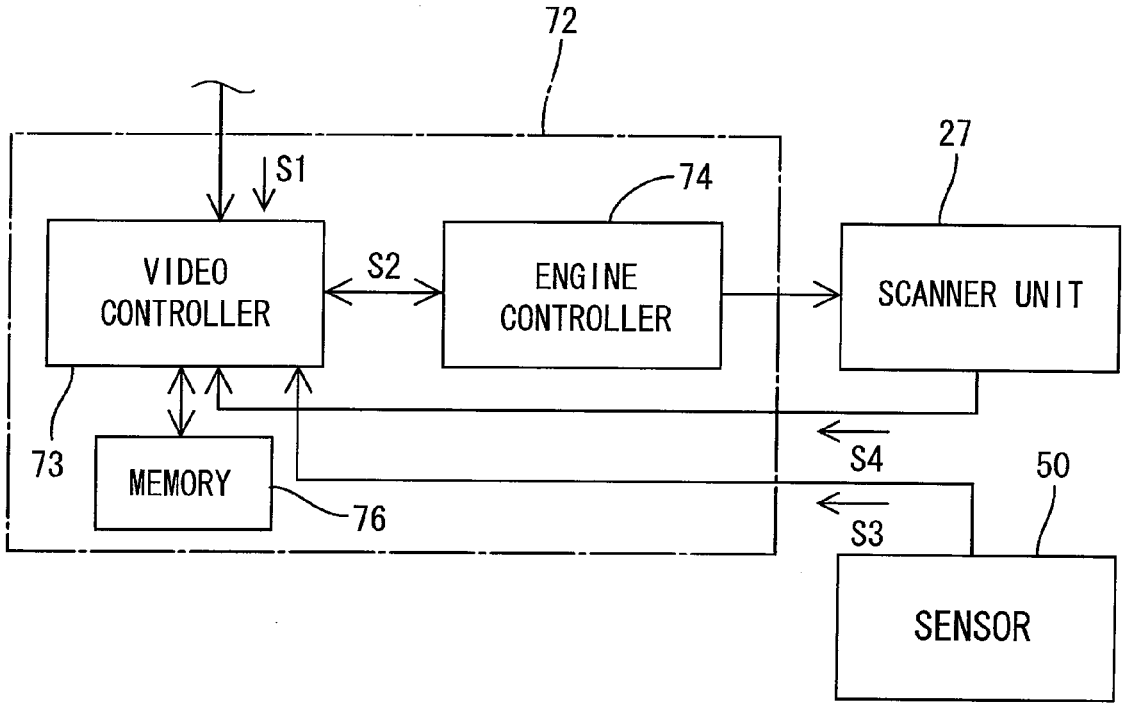
FIG. 3 is a block diagram of a control unit that controls a scanner unit.

FIG. 3 is a block diagram of a control unit 72 for controlling the scanner unit 27. The control unit 72 includes a video controller 73 and an engine controller 74. The video controller 73 receives image data S1 from a terminal (not shown) connected to the printer 1 allowed to communicate therewith so as to be developed into bit map data, and to generate an image forming video signal S2. The video controller 73 receives a signal obtained by performing the A/D conversion of a detection signal S3 from the sensor 50 as well as a BD signal S4 from a BD sensor (not shown) in the scanner unit 27 for detecting the laser beam. The BD sensor outputs the BD signal S4 after detecting the laser beam polarized by a polygon mirror (not shown) at a predetermined position.

The video controller 73 applies the black video signal S2 to the engine controller 74 after an elapse of the black BD time in reference to the timing at which the BD signal S4 is received, and allows the scanner unit 27 to start the operation of scanning the laser beam modulated based on the black video signal S2 on the black photo conductor drum 31*k*. Likewise, the operation of scanning on the cyan photo conductor drum 31*c* is started after the elapse of the cyan BD time. Further, the operation of scanning on the magenta photo conductor drum 31*m* is started after the elapse of the magenta BD time. The operation of scanning the yellow photo conductor drum 31*y* is started after the elapse of the yellow BD time. The toner images of the respective colors are sequentially transferred onto the sheet 4 conveyed on the belt 18 in the superimposing manner to form the color image.

The aforementioned black BD time, cyan BD time, magenta BD time and yellow BD time are used to determine the head position on the photo conductor drum 31 of the respective colors in the rotational direction, that is, the head position of the toner images of the respective colors on the belt in the sub-scanning direction (the same direction as the conveying direction). A memory 76 stores the information with respect to the corresponding head position in the sub-scanning direction. The memory 76 also stores the information with respect to the head position of the toner images of the respective colors in the main scanning direction (in the depth direction in FIG. 1). The video controller 73 generates the video signals S2 corresponding to the respective colors in accordance with the head position information in the main scanning direction based on the image data S1 so as to be applied to the engine controller 74 at a timing in accordance with the head position information in the sub-scanning direction. The developer cartridge 34, the scanner unit 27 and the control unit 72 serve as an example of the "developer image forming portion".

Structure for Detecting Transfer Position of Photo conductor Drum

Deviation of the transfer position of the photo conductor drum 31 of the respective colors onto the sheet 4 owing to the external impact or the change over time may cause color shift of the image formed on the sheet 4. According to at least one aspect of the present invention, printer 1 includes a registration function to detect the deviation amount of the transfer positions between the respective photo conductor drums 31 and to correct the deviation. More specifically, the memory 76 preliminarily stores image data for forming the registration pattern (hereinafter simply referred to as "pattern") on the belt 18 as shown in FIG. 4.

Figure 4:
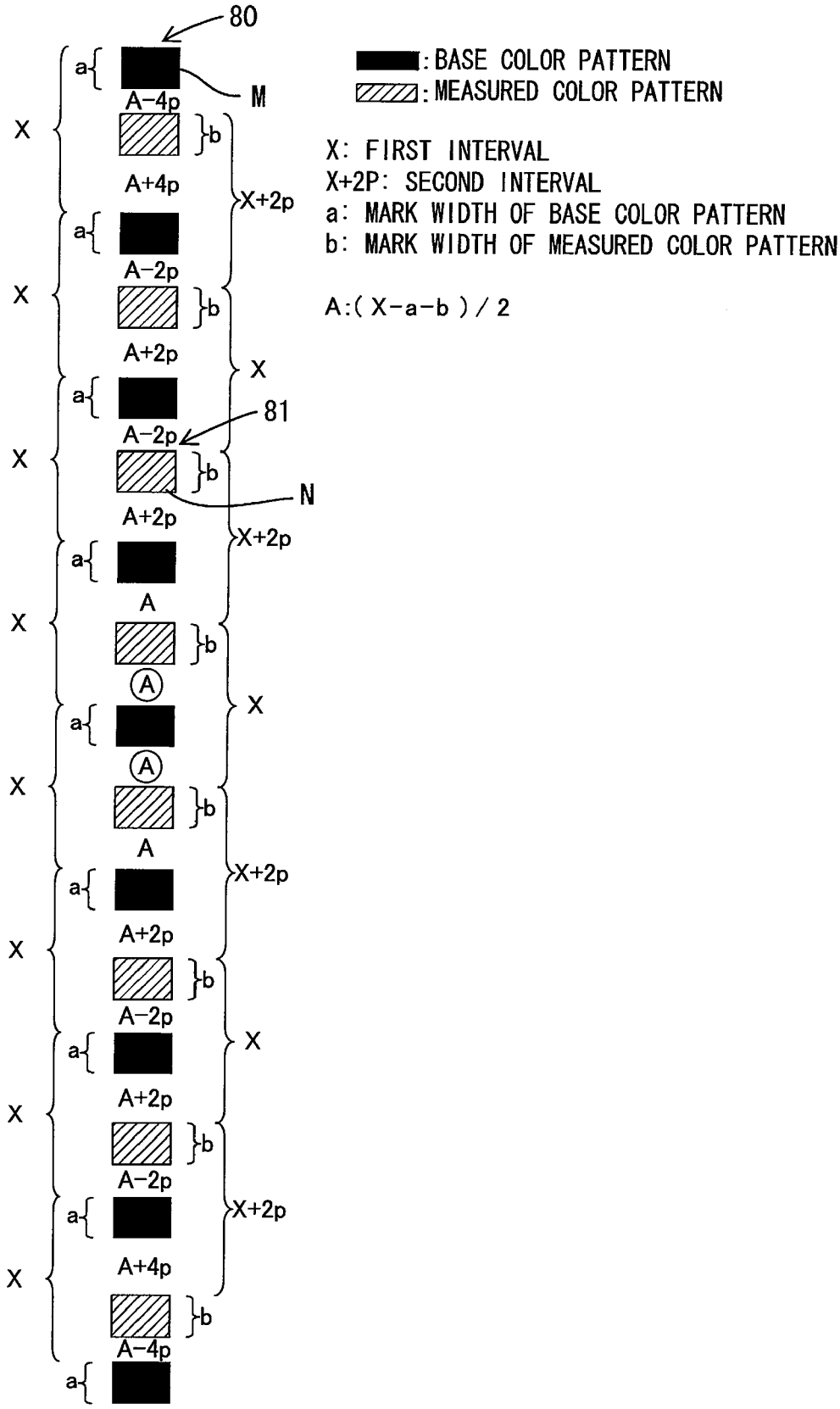
FIG. 4 is an explanatory view showing the registration pattern.

In FIG. 4, the upward direction represents the forward conveying direction. The black pattern is defined as a base color pattern 80 (an example of a "first pattern") in which a plurality of base color marks M (an example of a "first mark") are aligned at first intervals X (to be more precise, the front or the rear edges of the marks are aligned at the first intervals) in the conveying direction. The front and the rear edges of each of the base color marks M, which are an example of a "horizontal portion", are in parallel with the direction orthogonal to the conveying direction (main scanning direction).

The shaded pattern is defined as a measured color pattern 81 (and example of a "second pattern") in which a plurality of measured color marks N (an example of a "second mark") are aligned at the first intervals X and second intervals X+α alternately in the conveying direction (to be more precise, the front or the rear edges of the marks are aligned at the first and the second intervals alternately). The front and the rear edges (as an example of the "horizontal portion") of each of the measured color marks N are in parallel with the direction orthogonal to the conveying direction (main scanning direction). In this aspect, the difference α between the first interval X and the second interval X+α is set to the value 2p (twice the minimum detectable unit value p required for the transfer registration).

In the aspect, the toner image of the base color pattern 80 is transferred onto the belt 18 by the black photo conductor drum 31*k*, and the toner image of the measured color pattern 81 is transferred onto the belt 18 by the photo conductor drums corresponding to the other colors, that is, 31*c*, 31*m* and 31*y*, respectively. The deviation of each of the transfer position of the respective photo conductor drums 31*c*, 31*m* and 31*y* with respect to the transfer position on the belt 18 performed by the photo conductor drum 31*k* is detected. Accordingly, the black photo conductor drum 31*k* is an example of a "first photo conductor", and the photo conductor drums of the other colors, that is, 31*c*, 31*m* and 31*y* are an example of a "second photo conductors". The black will be referred to as the base color, and cyan, magenta and yellow will be referred to as the "measured color" hereinafter.

Referring to FIG. 4, the following condition can be met to allow the base color marks M of the base color pattern 80 and the measured color marks N of the measured color pattern 81 to alternately appear in the conveying direction. Assuming that the maximum deviation of the transfer position between the base color toner image and the measured color toner image is ±n·p, the minimum required numbers of the base color marks M and the measured color marks N are 2·n+1 and 2·n+2, respectively. The numbers of the spaces between the respective marks are 2·n and 2·n+1, respectively. In order to maintain the aforementioned appearance orders, 2·n−1 spaces between the adjacent measured color marks N is provided among all the 2·n·spaces (2·n·X) between the base color marks M. The number of the spaces between the measured color marks N at the second interval X+α (among 2·n−1 spaces between the measured color marks N) can be n or n−1.

The following condition can be established in the case where the number of spaces between the measured color marks N at the second interval X+α is n:

$$2\cdot n\cdot X>n\cdot(X+\alpha)+(n-1)\cdot X$$

where X>n·α.

The following condition can be established in the case where the number of spaces between the measured color makes N at the second interval X+α is n−1:

$$2\cdot n\cdot X>(n-1)\cdot(X+\alpha)+n\cdot X$$

where X>(n−1)·α.

Accordingly, at least the condition (1), that is, X>(n−1)·α should be satisfied.

In this aspect, the base color pattern 80 and the measured color pattern 81 are transferred in alignment along the conveying direction as shown in FIG. 4. In order to detect each edge of the respective marks by a single unit of the aforementioned sensor 50, a space should be formed between the base color mark M and the measured color mark N. Therefore the condition (2), that is, X>a+b should be satisfied as well.

Figure 1:
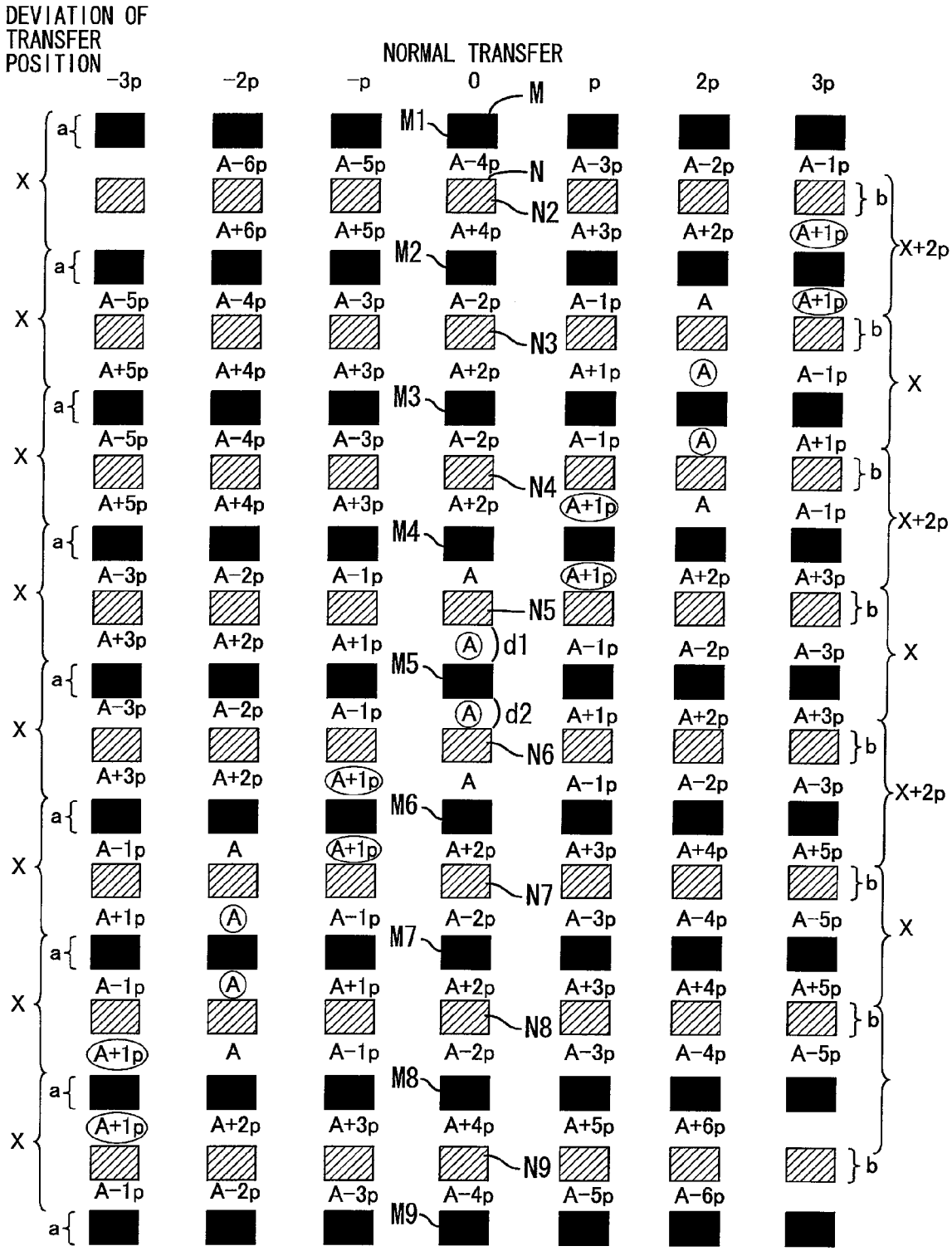
FIG. 1 is an explanatory view showing a relationship between a deviation amount of the transfer position (first and second patterns) and the transfer results of the registration pattern.

FIG. 1 shows transfer results of the base color pattern 80 and the measured color pattern 81 in the respective cases where the transfer position of the photo conductor drum 31*c* of the measured color deviates from the transfer position of the base color photo conductor drum 31*k* by p. In the drawing, the pattern at the center of the drawing in the left-to-right direction represents the transfer result with no deviation of the transfer position of the measured color photo conductor drum 31*c* from the transfer position of the base color photo conductor drum 31*k* (hereinafter referred to as the "normal transfer result"). The patterns at the right side of the drawing represent the transfer results each having the deviation of the transfer position by p, 2p, and 3p, respectively. The patterns at the left side of the drawing represent the transfer results each having the deviation of the transfer position by −p, −2p and −3p, respectively. The positive and negative signs represent the forward and reverse conveying directions. The base color marks M in the drawing are designated with the order numbers from M1 indicating the highest base color mark M in ascending sequence downward. The measured color marks N in the drawing are also designated with the order numbers from N1 indicating the highest measured color mark N in ascending sequence downward. In the drawing, the first measured color mark N is not shown.

The following findings (1) and (2) are obtained from the drawing. The distance between the base color mark M and the measured color mark N (that is adjacent to the front of the base color mark M in the conveying direction) is defined as d1, and the distance between the base color mark M and the measured color mark N (that is adjacent to the rear of the base color mark M in the conveying direction) is defined as d2.

(1) Referring to the transfer results, the difference between the distance from the base color mark M to the measured color mark N adjacent to the front thereof and the distance from the base color mark M to the measured color mark N adjacent to the rear thereof, that is, d1−d2 changes by α (=2p) as the base mark M shifts one order higher or lower.

(2) The base color mark M where the aforementioned distance difference (=d1−d2) is zero (hereinafter referred to as a "specific mark") moves to the base color mark M with one order higher or lower as the transfer position deviates by the value p. Specifically, the base color mark M5 of the normal transfer result shown in FIG. 1 will move to the base color mark M4 as the transfer position deviates by p. The base color mark M5 will move to the base color mark M3 as the transfer position deviates by 2p.

In this aspect, the findings (1) and (2) are considered in a method of detecting the transfer position. That is, the base color mark M (as the specific mark) is identified from those of the base color pattern 80 of the actual transfer results. The number of the order of the base color mark M (as the specific mark) which has moved from the base color mark M as the specific mark in the normal transfer result (the difference of the order number of the base color mark M as the specific mark between the normal transfer result and the actual transfer result), and the aforementioned p (=α/2) can be referred to as the order difference information. The deviation of the transfer position is detected, based on the order difference information.

More specific process for the aforementioned operation will be described referring to FIGS. 5 and 6. The control unit 72 executes the registration function by performing the process shown in the flowchart of FIG. 5 at a timing when the printer 1 is not activated for forming the image onto the sheet 4 (for example, the standby period for the request of image forming onto the sheet 4 after turning the power of the printer 1 ON). First in S1, the control unit 72 executes initialization by reading the initial value of the head position of the base color (black) toner image in the sub-canning direction, and the initial value of the head position of the measured color (cyan, for example) toner image in the sub-scanning direction from the memory 76, respectively.

In S2, the registration pattern printing is executed. Specifically, at the BD timing corresponding to the initial value, the electrostatic latent image of the base color pattern 80 is formed on the photo conductor drum 31*k*, and the electrostatic latent image of the measured color pattern 81 is formed on the photo conductor drum 31*c*. The base color pattern 80 and the measured color pattern 81 obtained by developing electrostatic latent images of the respective colors are formed on the belt 18 that is moving.

In S3, the control unit 72 detects the transfer position based on the fluctuation (rising edge and falling edge) in the level of the detection signal S3 from the sensor 50. Specifically, the control unit 72 initializes the order number n of the base color mark M to 1, and the order number m with the minimum distance difference to 0, and sets the distance ratio D(0) to a value larger than the maximum possible value of D(n) (for example, 2 in this aspect) in S11 shown in FIG. 6. Then in S12, the distance d1 between the first measured color mark N1 and the first base color mark M1 is detected, and the distance d2 between the first base color mark M1 and the second measured color mark N2 is detected. Those distances d1 and d2 may be detected based on the detection timing of the rising edge and the falling edge of the detection signal S3 from the sensor 50.

The control unit 72 calculates the distance ratio D(1)(=d1/d2) in S13, and it is determined whether the calculated distance ratio is equal to or larger than 1 in S14. When it is equal to or larger than 1, that is, Y is obtained in S14, the process proceeds to S15. Meanwhile, when it is smaller than 1, that is, N is obtained in S14, the distance ratio D(1) is set to the value of d2/d1 as the inverse number, and the process proceeds to S15. In S15, the respective absolute values of the D(0)−1 and D(1)−1 are compared. When the value D(1)−1 is smaller, that is, Y is obtained in S15, the order number m with the minimum distance difference to "1" in S17. When the value D(0)−1 is smaller, that is, N is obtained in S15, the order number m with the minimum distance difference is kept "0", and the process from S12 to S17 is executed by the cycle corresponding to the number n of the base color marks M1. The process then proceeds to S20 through S18 and S19. Among n base color marks M, the base color mark M with the distance ratio (d1/d2) that is the closest to "1" is extracted as the specific mark. At this time, the control unit 72 serves as an example of an "extraction unit".

Referring to FIG. 1, in the case where the transfer position deviates from the one in the normal transfer by +p, for example, the fourth base color mark M4 is extracted as the specific mark (the order number m with the minimum distance difference is set to 4). In the case where the transfer position deviates from the one in the normal transfer by −3p, the eighth base color mark M8 is extracted as the specific mark (the order number m with the minimum distance difference is set to 8).

The control unit 72 calculates the deviation amount of the transfer position in S20. Specifically, the memory 76 stores the order number "r" of the base color mark M with the distance ratio (d1/d2) that is the closest to "1" among the n base color marks M in the normal transfer. The control unit 72 calculates the difference between the order numbers (r-m) of the base color mark M extracted as the specific mark in the actual transfer and the base color mark M extracted in the normal transfer, and further calculates the value (p·(r−m)) by multiplying the minimum detection unit p (=α/2) required for the transfer registration by the calculated difference. The resultant value represents the deviation amount of the transfer position of the cyan photo conductor drum 31*c* from the black photo conductor drum 31*k*. The control unit 72 at this time serves as an example of a "detection unit".

Figure 5:
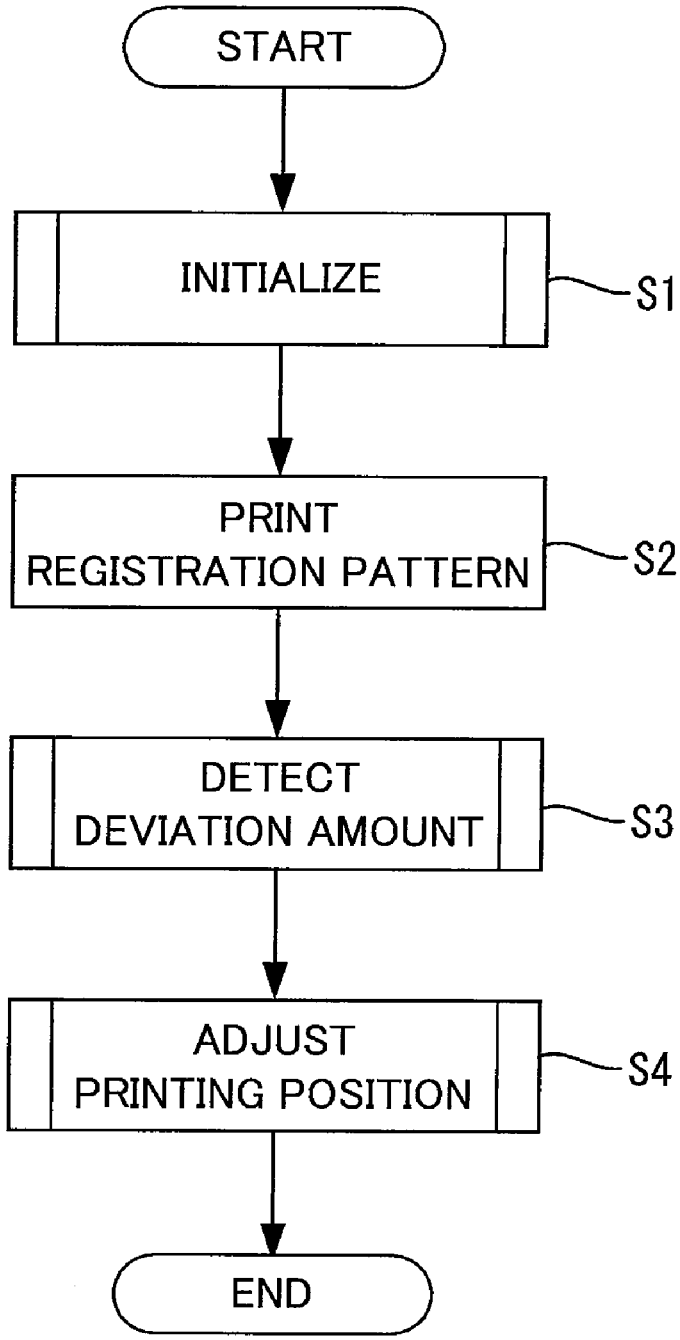
FIG. 5 is a flowchart showing a main routine of a registration process.

The process returns to S4 of the flowchart shown in FIG. 5 where the control unit 72 executes the print position adjustment. More specifically, the initial value of the cyan head position information in the sub-scanning direction stored in the memory 76 is corrected by the value obtained by making the deviation amount calculated in S20 negative (=−p·(r−m)). The corrected value is then stored in the memory 76. In response to the image forming requirement issued to the printer 1, the video controller 73 starts scanning onto the cyan photo conductor drum 31*c* at the timing obtained by correcting the cyan BD time corresponding to the initial value by the time equivalent to the deviation. The black toner image by the black photo conductor drum 31*k* and the cyan toner image by the cyan photo conductor drum 31*c* may be transferred onto the sheet 4 in the sub-scanning direction with no deviation.

Figure 6:
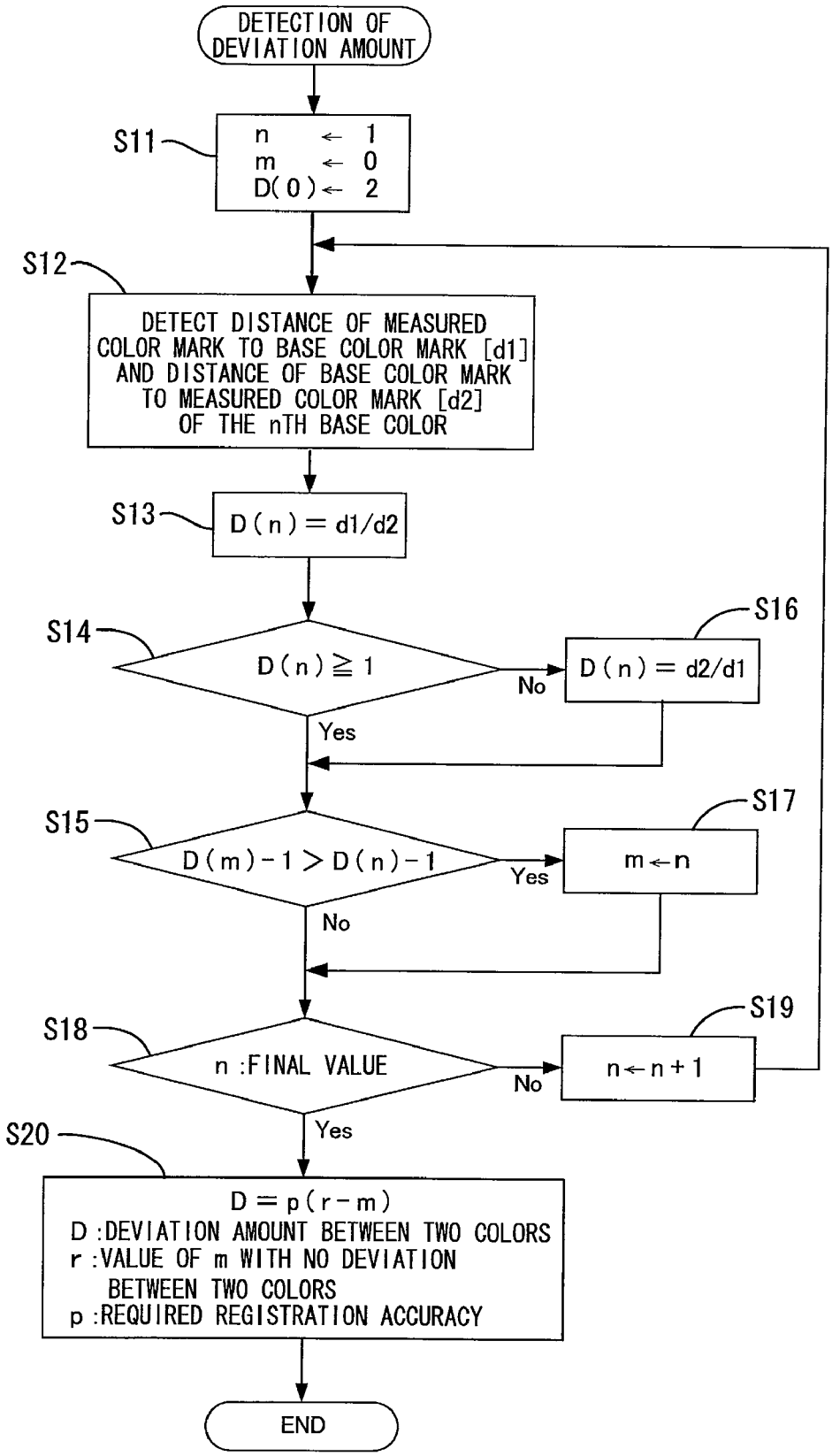
FIG. 6 is a flowchart showing a detection process.

The process shown in the flowcharts of FIGS. 5 and 6 is executed with respect to the black photo conductor drum 31*k* and the magenta photo conductor drum 31*m*, and the black photo conductor drum 31*k* and the yellow photo conductor drum 31*y* sequentially so that the magenta toner images and the yellow toner images can be transferred onto the sheet 4 with no positional deviation. This makes it possible to transfer the color image with no color shift as a whole onto the sheet 4. The control unit 72 at this time serves as an example of a "correction unit".

Effects of this Aspect (1) As described above, each difference D(n) of distances between the base color mark M and the two measured color marks N adjacent to the front and to the rear thereof changes in the conveying (sub-scanning) direction by α (=2p). Even if the accuracy of the sensor 50 fails to reach the level of the minimum unit of p required for detecting the transfer position, the aforementioned specific mark may be extracted so long as it exhibits the detection accuracy in the unit of 2p (=α). This makes it possible to detect the transfer position with the accuracy in the unit of p by calculating the order number information and the minimum unit p.

If the sensor with the same detection accuracy is required to be used to detect the transfer position at the same accuracy level, the sensor may be disposed remote from the medium, thus increasing the freedom degree in the arrangement of the sensor compared with the conventional printer.

(2) In this aspect, the difference of the distance (=d1−d2) between the base color mark M and the two measured color marks N adjacent to the front and to the rear thereof is not used but the distance ratio (d1/d2) is used for calculating the deviation amount of the transfer position. This makes it possible to suppress the influence of the change over time in the irradiation quantity or light receiving quantity of the sensor 50.

(3) The base color pattern 80 and the measured color pattern 81 are transferred in alignment along the conveying direction. Only a single sensor 50 is sufficient for detecting patterns 80 and 81.

Next, another illustrative aspect of the invention is substantially the same as the first aspect except for a difference in the method of extracting the specific mark. Therefore, the same components of the second aspect as those of the first aspect will be designated with the same reference numerals, and explanations thereof will be omitted.

Referring to the transfer results shown in FIG. 1, the base color mark M (as the specific mark) with the distance difference of zero (in other words, the distance radio D(n) which is the closest to 1), exists at substantially an intermediate position between two base color marks M each having substantially the same absolute value of the distance difference (=|d1−d2|) in the conveying direction. Referring to the normal transfer state shown in FIG. 1, for example, the fifth base color mark M5 exists at the intermediate position between the fourth and the sixth base color marks M4 and M6 with the absolute value of the distance difference of 2p, between the third and the seventh base color marks M3 and M7 with the absolute value of the distance difference of 4p, and between the second and the eighth base color marks M2 and M8 with the absolute value of the distance difference of 6p, respectively.

In the second aspect, the control unit 72 calculates each distance ratio D(n)(=d1/d2) of the respective base color marks M based on the detected rising and falling edges of the detection signal S3 from the sensor 50. Then, the base color mark M of the pair in which the inverse number of one distance ratios D(n) substantially matches the other distance ratio D(n) is extracted. The base color mark M with the intermediate order number between those paired base color marks M is extracted as the specific mark. As shown in FIG. 1, in the case where the inverse number of one of the distance ratios D(n) is obtained, a plurality of pairs can satisfy the condition that the inverse number of one distance ratios D(n) substantially matches the other distance ratio D(n). In the aspect, among the plurality of the extracted specific marks, the base color mark M (with the order number which is the most frequently extracted) is selected as the final specific mark to calculate the deviation amount.

Even if the detection signal S3 from the sensor 50 temporarily contains a noise that causes a detection error of the distance ratio with respect to a certain base color mark M, the aforementioned structure for extracting the specific mark based on a plurality of base color marks M allows accurate extraction of the specific mark by suppressing the influence resulting from such error.

In the second aspect, the relative ratio of the distance is used for extracting the specific mark instead of the difference in absolute values between the distances d1 and d2, that is, the distance between the base color mark M and the two measured color marks N adjacent to the front and to the rear of the case color mark M. This may suppress the influence of the change over time in the irradiation quantity or light receiving quantity of the sensor 50.

Figure 7:
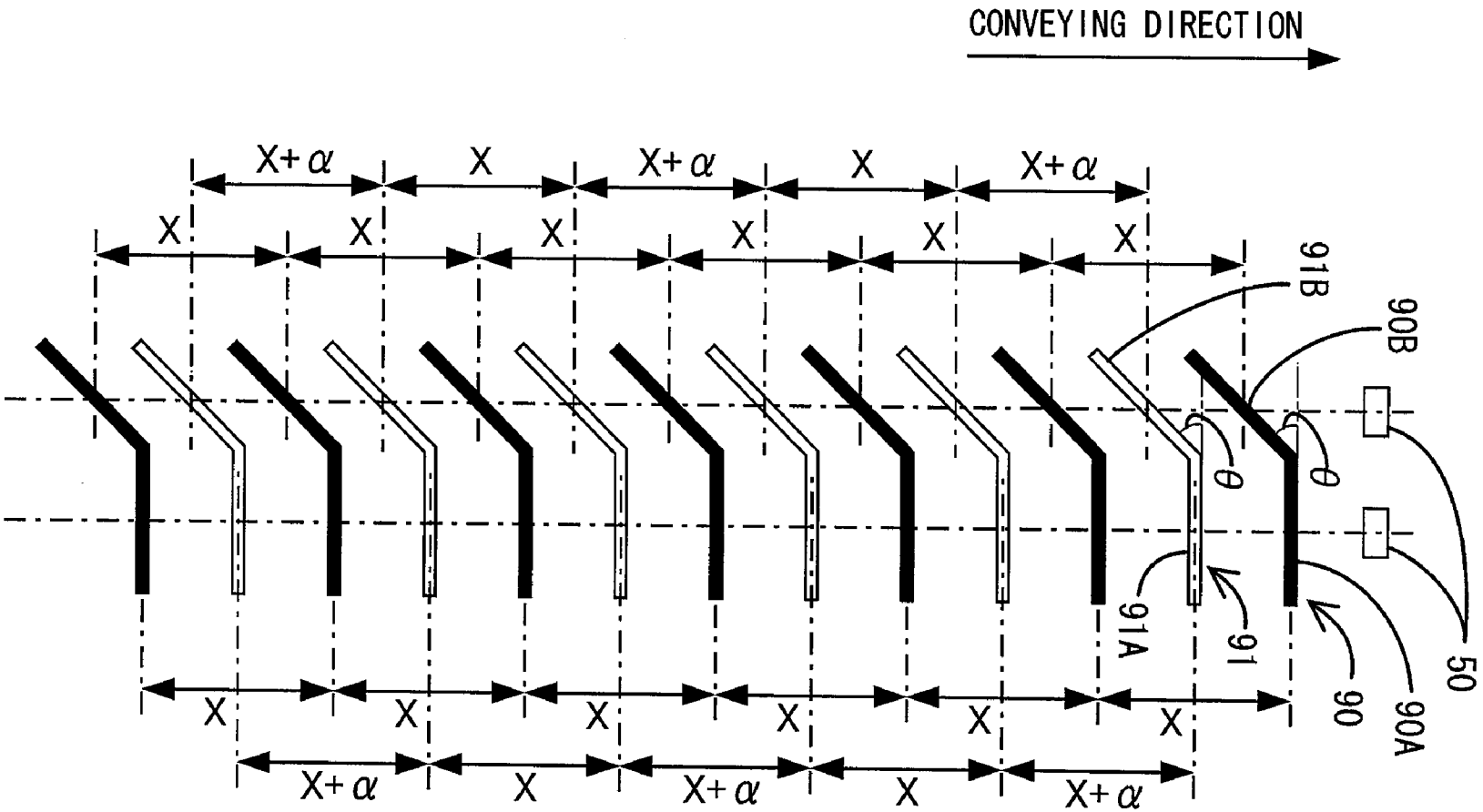
FIG. 7 is an explanatory view of the registration pattern according to a another aspect.
Figure 8:
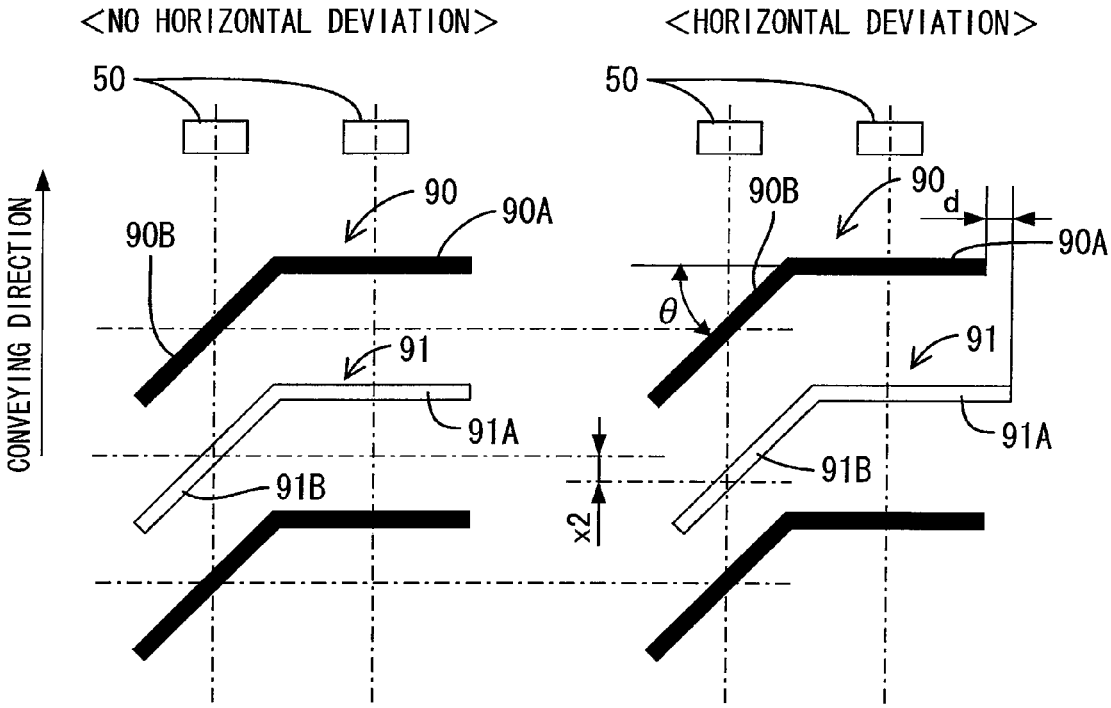
FIG. 8 is a diagram representing how the deviation amount of the transfer position in the main scanning direction is obtained.

FIGS. 7 and 8 show another aspect which is substantially the same as the first aspect except for different configurations of the base color pattern and the measured color pattern. The same components as those of the first aspect will be designated with the same reference numerals, and explanations thereof will be omitted.

Referring to FIG. 7, a base color pattern 90 (black mark) and a measured color pattern 91 (white mark) in the aspect are configured to have horizontal portions 90A and 91A each having front and rear edges along the main scanning direction, and slope portions 90B and 91B each having the front and rear edges inclined at an angle θ with respect to the main scanning direction.

In the base color pattern 90, both the horizontal portions 90A and the slope portions 90B are aligned at the first intervals X in the conveying direction (to be more precise, the front or the rear edges are aligned at the first intervals). In the measured color pattern 91, the horizontal portions 91A and the slope portions 91B are aligned at the first intervals X and the second intervals X+α, alternately (to be more precise, the front or the rear edges are aligned at the first intervals X and the second intervals X+α alternately).

Two sensors 50 and 50 are disposed, each of which independently detects the horizontal portions 90A and 91A, and the slope portions 90B and 91B of the base color pattern 90 and the measured color pattern 91, respectively. The process shown in the flowchart of FIG. 6 is executed with respect to the horizontal portions 90A and 91A to detect a deviation amount x1 of the transfer position of the base color and the measured color in the sub-scanning direction. The process from S11 to S20 in the flowchart of FIG. 6 is executed to calculate a deviation amount x2 with respect to the slope portions 90B and 91B. As shown in FIG. 8, the value d obtained by dividing the value (x2−x1) derived from subtracting the deviation amount x1 from the deviation amount x2 by tan θ is the deviation amount of the transfer position in the main scanning direction of the base color and the measured color. In the case where the deviation amount x1 in the sub-scanning direction is 0 (zero), the value d obtained by dividing the deviation amount x2 by the tan θ is the deviation amount of the transfer position in the main scanning direction of the base color and the measured color.

This aspect provides the similar effect as that derived from the first aspect with respect to the detection of the transfer position in the main scanning direction in addition to the detection in the sub-scanning direction. Note that the method of extracting the specific mark as in the second aspect may be employed for realizing the structure of this aspect.

Other Aspects

The invention is not limited to the aspects which have been described referring to the drawings. The following aspects may also be included in the scope of the invention.

(1) The respective aspects may be structured to include a setting unit that allows the minimum detection unit p (=α/2) (corresponding to the detection accuracy used for the transfer registration) to be variable to an arbitrary value so as to transfer the patterns 80, 81, 90 and 91 at the intervals each corresponding to the value of p set by the setting unit.

(2) In the respective aspects, the respective photo conductor drums 31 are configured to transfer different color images. However, the invention is not limited to this, and the photo conductor drums 31 may be structured to transfer the same color images partially or entirely. In the above aspects, the color printer is structured to print four color images, that is, black, cyan, magenta and yellow. However, any colors other than the aforementioned four colors may be used. For example, the printer for printing six or two color images may also be employed.

(3) In the respective aspects, black is defined as the base color. However, other colors may be defined as the base color.

(4) In the aspect illustrated in FIG. 7 and FIG. 8, the base color pattern 90 and the measured color pattern 91 including the horizontal portions 90A and 91A and the slope portions 90B and 91B are transferred so as to allow the detection of the transfer position in the main scanning direction in addition to the sub-scanning direction. However, the invention is not limited to this. For example, patterns having no horizontal portions 90A and 91A may be used to detect the deviation amount of the transfer position only in the main scanning direction.

(5) In the aspect illustrated in FIG. 2-FIG. 6, the base color mark M at the intermediate position between two measured color marks N is defined as the specific mark. However, the invention is not limited to this. For example, the base color mark M having a predetermined value of the distance difference or the distance ratio between the base color mark M and the measured color marks N adjacent to the front and to the rear thereof may be extracted as the specific mark.

Figure 9:
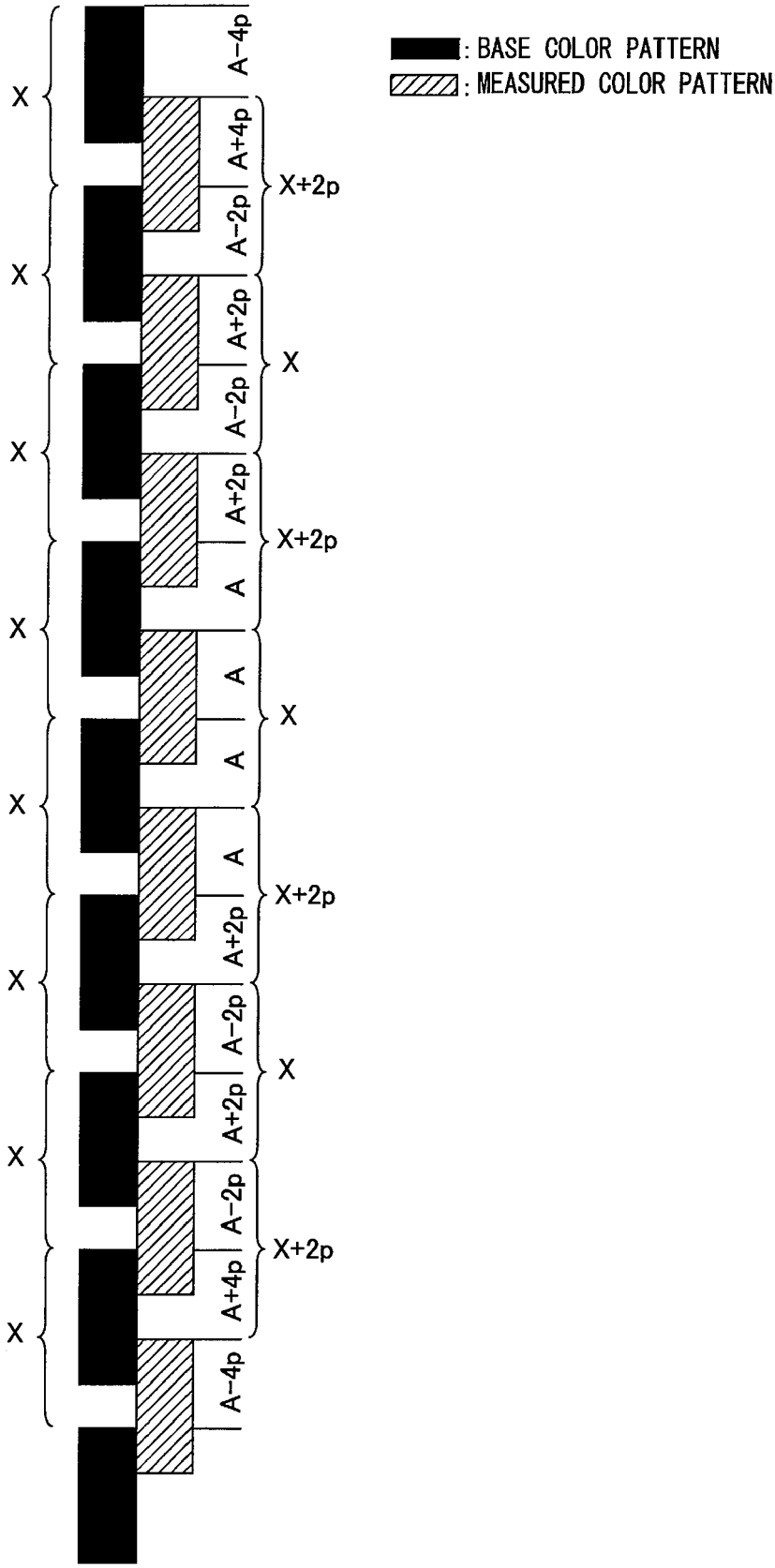
FIG. 9 is a first explanatory view showing a registration pattern according to a modified example.

(6) In the illustrative aspect illustrated in FIG. 2~FIG. 6, the base color pattern 90 and the measured color pattern 91 are transferred in alignment along the conveying direction. However, the invention is not limited to this. For example, patterns may be transferred at shifted positions in the main scanning direction as shown in FIG. 9 (A=X/2). In this case, the first interval X and the difference value α are provided to meet the aforementioned condition (1). In this case, two sensors 50 corresponding to the respective patterns are provided.

(7) In the respective aspects, the "medium" is the belt 18. However, it is not limited to this, and it may also be the sheet 4. The sheet 4 may be conveyed during the registration process such that the registration pattern is transferred onto the sheet 4.

(8) In the respective aspects, the deviation amount of the transfer position is calculated by the control unit 72. However, the invention is not limited to this. For example, the operator is allowed to obtain the deviation amount of the transfer position on the discharged sheet 4 on which the patterns are transferred by visually observing the transfer results or using the predetermined measurement device. In the aforementioned case, the transfer position may be detected with the accuracy substantially twice as high as the accuracy for detecting the distance between the marks.

(9) In the above aspects, the reflective photo electronic sensor is employed as the sensor. However, the transmission type photo electronic sensor may be employed so long as the belt 18 exhibits the light transmission property. The sensor is not limited to the photo electronic sensor, and a sensor that detects the difference in the charge level may be employed.

Figure 10:
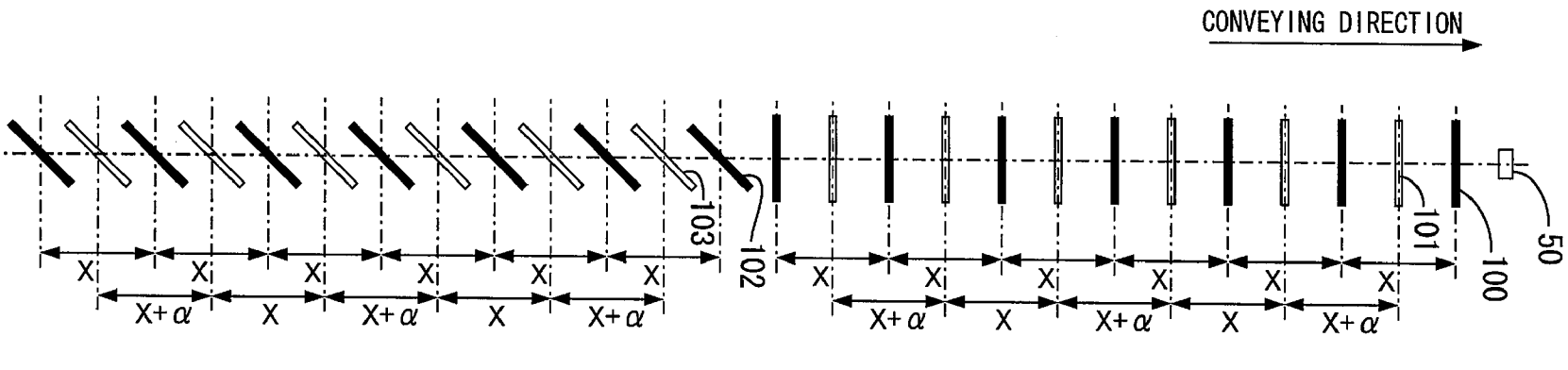
FIG. 10 is a second explanatory view showing a registration pattern according to a modified example.

(10) In the aspect illustrated in FIG. 7 and FIG. 8, the horizontal portions and the slope portions of the patterns 90 and 91 are horizontally arranged in the main scanning direction. However, the invention is not limited to this. For example, the base color pattern may be configured to arrange the mark group 100 which contains horizontal portions and the mark group 102 which contains the slope portions in alignment along the conveying direction as shown in FIG. 10. Likewise, the measured color pattern may be configured to arrange the mark group 101 which contains horizontal portions and the mark group 103 which contains the slope portions in alignment along the conveying direction. The aforementioned structure includes only a single unit of the sensor 50 for detecting the transfer position both in the sub-scanning direction and the main scanning direction.

(11) In the aspects, the specific mark may be extracted as in the first aspect such that the transfer position is detected based on the specific mark which is the most frequently extracted among the plurality of the specific marks. This makes it possible to improve the reliability with respect to extraction of the specific mark.

What is claimed is:

1. An image forming apparatus comprising:

a feeding unit that feeds a medium;

a plurality of image carriers arranged in parallel along a moving direction of said medium;

a developer image forming unit that forms a developer image on said plurality of image carriers; and a transfer unit that transfers said developer image formed on said plurality of image carriers onto said medium;

wherein said developer image forming unit forms a first developer image on a first image carrier of said plurality of image carriers, said first developer image being used for transferring a first pattern formed of a plurality of first marks arranged at a first interval on said medium along said feeding direction; and wherein said developer image forming unit forms a second developer image on a second image carrier of said plurality of image carriers, said second developer image being used for transferring a second pattern formed of a plurality of second marks arranged at said first interval and a second interval alternately on said medium along said feeding direction.

2. The image forming apparatus according to claim 1, wherein said plurality of first marks and second marks have horizontal portions along a direction orthogonal to said moving direction on said medium.

3. The image forming apparatus according to claim 1, wherein said plurality of first marks and second marks have slope portions inclined at a predetermined angle with respect to a direction orthogonal to said moving direction on said medium.

4. The image forming apparatus according to claim 1, further comprising:

a sensor that detects said first pattern and said second pattern;

an extraction unit that extracts, as a specific mark, a first mark of the plurality of first marks having a predetermined value of at least one of a distance difference and a distance ratio between said first mark and each of two second marks of the plurality of second marks adjacent to the front or to the rear of said first mark in said moving direction from those of said first pattern based on a detection result of said sensor.

5. The image forming apparatus according to claim 4, further including a detection unit that detects a deviation amount of a transfer position between at least two of the plurality of image carriers based on the extraction result of said extraction unit and a difference between said first interval and said second interval.

6. The image forming apparatus according to claim 5, wherein said extraction unit is structured to extract said first mark with a minimum value of the distance difference as said specific mark.

7. The image forming apparatus according to claim 5, wherein said extraction unit calculates a relative ratio of the distances between said first mark and said two second marks and extracts a first mark with the relative ratio closest to 1 as said specific mark.

8. The image forming apparatus according to claim 6, wherein:

said extraction unit further extracts two first marks of the plurality of first marks, each having a closest absolute value of said distance difference such that said first mark at an intermediate position between said two first marks is extracted as said specific mark; and said detection unit executes the detection based on said specific mark which is the most frequently extracted from the plurality of said specific mark extracted.

9. The image forming apparatus according to claim 7, wherein:

said extraction unit further extracts two first marks of the plurality of first marks, each having a closest absolute value of said distance difference such that said first mark at an intermediate position between said two first marks is extracted as said specific mark; and said detection unit executes the detection based on said specific mark which is the most frequently extracted from the plurality of said specific mark extracted.

10. The image forming apparatus according to claim 5, wherein said extraction unit extracts two first marks of the plurality of first marks, each having a closest absolute value of said distance difference such that said first mark at an intermediate position between said two first marks is extracted as said specific mark.

11. The image forming apparatus according to claim 10, wherein said detection unit detects the most frequently extracted specific mark among a plurality of said specific mark extracted.

12. The image forming apparatus according to claim 5, wherein said first developer image and said second developer image are used for transferring said first pattern and said second pattern on said medium in alignment along said moving direction.

13. The image forming apparatus according to claim 5, further comprising a correction unit that corrects said deviation amount between at least two of the plurality of image carriers based on the detection result of said detection unit.

14. An image forming apparatus comprising:

a plurality of image carriers positioned adjacent a medium, the plurality of image carriers including a first and second image carrier;

a developer image forming unit configured to form a first developer image on the first image carrier, the first developer image enabling a transfer of a plurality of first marks in a first interval on the medium, and configured to form a second developer image on the second image carrier, the second developer image enabling a transfer of a plurality of second marks arranged at said first intervals and second intervals alternately on said medium; and a transfer unit configured to transfer said developer images formed on said plurality of image carriers onto said medium.

15. An image forming apparatus comprising:

a belt unit that includes a belt and a belt drive unit which rotatably moves the belt;

a plurality of image carriers arranged in parallel along a moving direction of the belt;

an image forming unit that forms developer images on the plurality of image carriers; and a transfer unit that transfers the developer images onto the belt, wherein the image forming unit forms a first developer image on a first image carrier of the plurality of image carriers, the transfer unit transfers the first developer image onto the belt in a first pattern, and the first pattern is formed of a plurality of first marks arranged at a first interval on the belt along the moving direction, further wherein the image forming unit forms a second developer image on a second image carrier of the plurality of image carriers, the transfer unit transfers the second developer image onto the belt in a second pattern, and the second pattern is formed of a plurality of second marks arranged at the first interval and a second interval alternately on a belt along the moving direction.

16. The image forming apparatus of claim 15, wherein the belt is an intermediate belt that carries the developer image from the image carriers to the medium to form images.

17. The image forming apparatus of claim 15, wherein the belt is a feeding belt that conveys the medium to form images.

18. The image forming apparatus according to claim 15, wherein said plurality of first marks and second marks have horizontal portions along a direction orthogonal to said moving direction on said medium.

19. The image forming apparatus according to claim 15, wherein said plurality of first marks and second marks have slope portions inclined at a predetermined angle with respect to a direction orthogonal to said moving direction on said medium.

20. The image forming apparatus according to claim 15, further comprising:

a sensor that detects said first pattern and said second pattern;

an extraction unit that extracts, as a specific mark, a first mark of the plurality of first marks having a predetermined value of at least one of a distance difference and a distance ratio between said first mark and each of two second marks of the plurality of second marks adjacent to the front or to the rear of said first mark in said moving direction from those of said first pattern based on a detection result of said sensor.

* * * * *